US005316154A

United States Patent [19]

Hajec, Jr.

[11] Patent Number: 5,316,154

[45] Date of Patent: May 31, 1994

[54] RACK FOR STORING AND DISPENSING PLASTIC OIL CONTAINERS

[76] Inventor: John W. Hajec, Jr., P.O. Box 2006, Eaton, Colo. 80615

[21] Appl. No.: 971,358

[22] Filed: Nov. 4, 1992

[51] Int. Cl.[5] ..... A47F 5/00

[52] U.S. Cl. ..... 211/59.2; 312/45

[58] Field of Search ..... 211/59.2, 74; 312/45, 312/72, 73

[56] References Cited

U.S. PATENT DOCUMENTS

| | | | |
|---|---|---|---|
| 1,054,707 | 3/1913 | Mertens | 211/59.2 |
| 1,125,174 | 1/1915 | Rextrew | 211/59.2 X |
| 2,212,129 | 8/1940 | Rust | 211/59.2 X |
| 2,826,471 | 3/1958 | Fonda | 312/45 X |
| 3,018,001 | 1/1962 | Combs | 211/59.2 |
| 3,744,866 | 7/1973 | Cook | 211/59.2 X |
| 5,135,135 | 8/1992 | Oliver | 211/59.2 X |

FOREIGN PATENT DOCUMENTS

| | | | |
|---|---|---|---|
| 394433 | 6/1933 | United Kingdom | 312/45 |

*Primary Examiner*—Robert W. Gibson, Jr.
*Attorney, Agent, or Firm*—William E. Hein

[57] ABSTRACT

An elongated rack vertically mounted for storing and dispensing one-quart plastic oil containers is rigidly formed to include a top opening, a rear surface, parallel side surfaces extending forward of the rear surface and perpendicular thereto, a bottom surface, and an outwardly angled front surface. The side surfaces and the front surface are notched upward and rearward to create an opening through which only the bottom one of a stack of oil containers in the rack may be withdrawn.

5 Claims, 2 Drawing Sheets

RACK FOR STORING AND DISPENSING PLASTIC OIL CONTAINERS

BACKGROUND AND SUMMARY OF THE INVENTION

This invention relates generally to storage racks and, more particularly, to a rack for storing and dispensing conventional one-quart oil containers.

Many automobile, truck, tractor, and machinery owners and operators change and/or add their own oil to these vehicles as required. The oil used is typically packaged in plastic one-quart containers and is often purchased in cases of twelve such containers. These one-quart containers are typically generally rectangular in cross section as opposed to the older style cylindrical cans. They are typically stored on shelves or used directly from the cardboard cases in which they are packaged. Storing these containers on shelves either individually or in their cases results in poor utilization of shelf space. Withdrawing them as needed directly from the case is awkward.

It is therefore a principal object of the present invention to provide a rack for storing and dispensing conventional one-quart plastic oil containers in which the containers may be conveniently withdrawn one at a time and in which new containers are loaded on top of previously loaded containers, thereby resulting in a desirable first in-first out rotation of containers.

It is a further object of the present invention to provide a rack for storing and dispensing conventional one-quart oil containers that may be conveniently mounted on a wall or work bench and that allows the user to determine at a glance how may containers remain in the rack.

These and other objects are accomplished in accordance with the illustrated preferred embodiment of the present invention by providing an elongated rack rigidly formed to include a top opening, a rear surface, parallel side surfaces extending forward of the rear surface and perpendicular thereto, a bottom surface, and a forwardly angled front surface. The side surfaces and the front surface are notched upward and rearward adjacent the bottom surface to create an opening through which only the bottom one of a stack of oil containers in the rack may be withdrawn.

DETAILED DESCRIPTION OF THE INVENTION

Figure 1:
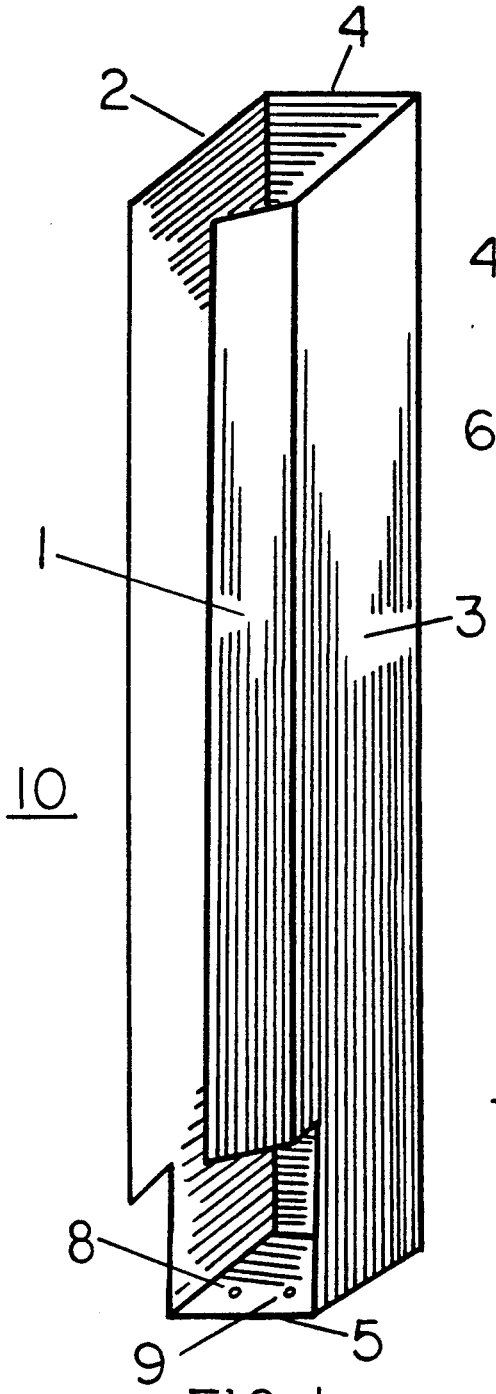
FIG. 1 is a front pictorial diagram of the rack for storing and dispensing plastic oil containers in accordance with the present invention.
Figure 2:
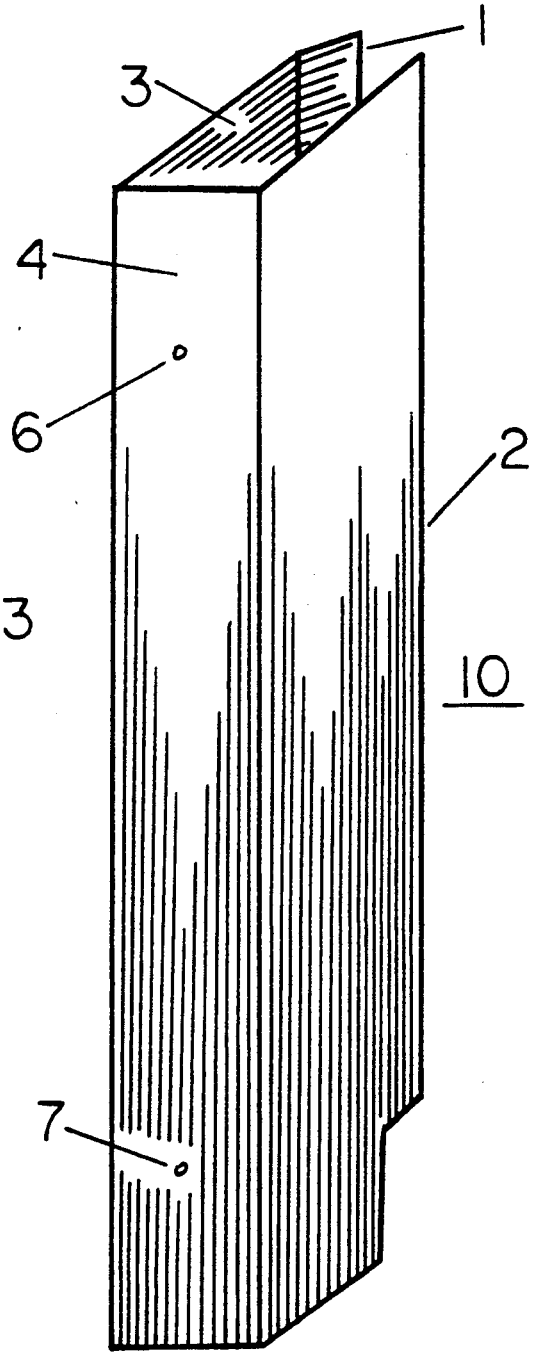
FIG. 2 is a rear pictorial diagram of the rack of FIG. 1.
Figure 3:
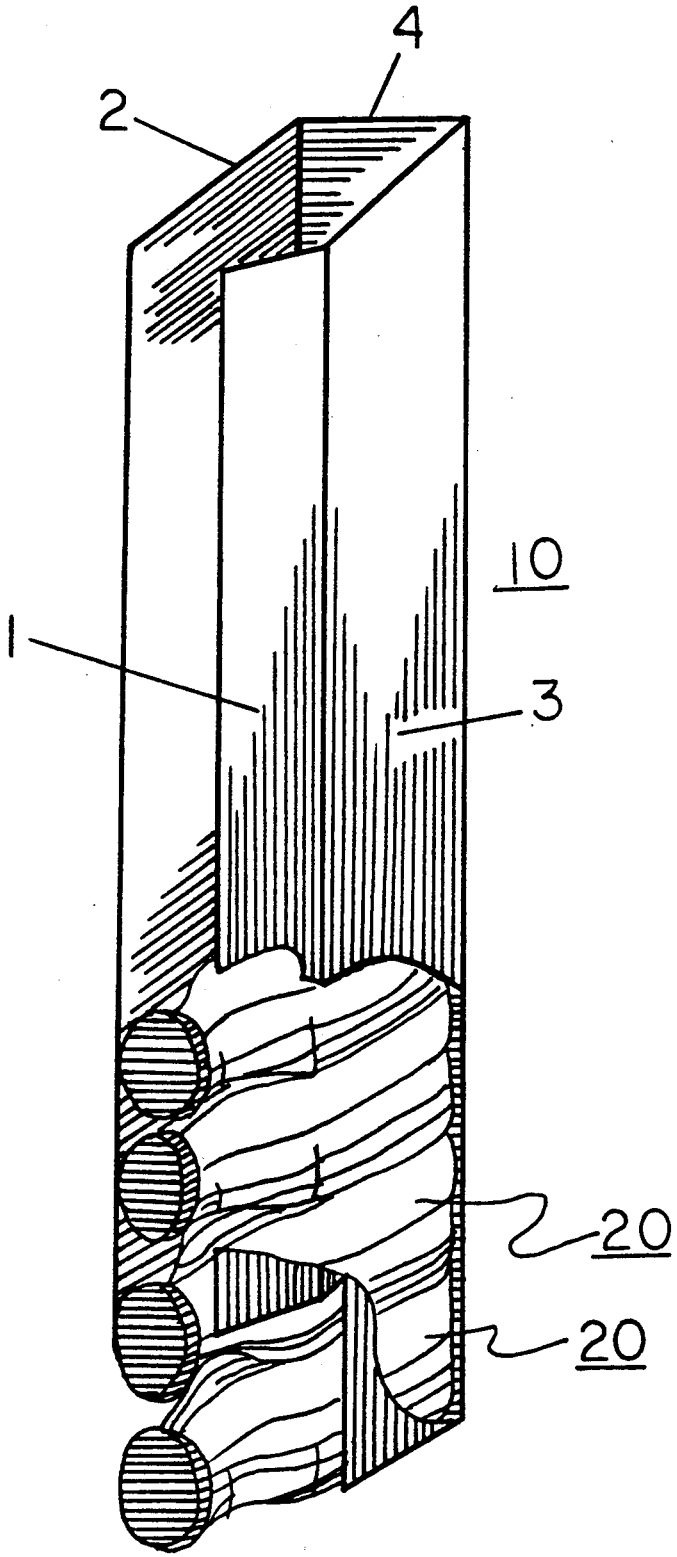
FIG. 3 is a front pictorial diagram of the rack of FIGS. 1 and 2, cut away to illustrate the way in which plastic oil containers are stacked therein and dispensed therefrom.

Referring now to FIGS. 1-3, there is shown an elongated rack 10 for storing and dispensing a plurality of conventional one-quart plastic oil containers 20. Rack 10 is formed to include a rear surface 4, parallel side surfaces 2, 3 that extend forward from the rear surface 4 and are perpendicular thereto, a bottom surface 5, and a forwardly angled front surface 1. Rack 10 is open at its top. Side surfaces 2, 3 and front surface 1 are notched upward from bottom surface 5 and rearward from the front of rack 10 to provide an opening through which one-quart plastic oil containers 20 stacked as illustrated in FIG. 3 may be individually withdrawn. The height of the notches in side surfaces 2, 3 and front surface 1 is slightly greater than the thickness of one of the plastic oil containers 20 stacked in rack 10 to permit withdrawal of only one of the containers 20 at a time. Front surface 1 is angled forwardly, as illustrated, to accommodate the shape of the cap end of conventional one-quart plastic oil containers 20 and to provide a longitudinal frontal opening in rack 10 adjacent one of the side surfaces 2, 3 for receiving the cap end of each of the containers 20.

Rack 10 may be conventionally fabricated of any of a number of commercially available rigid materials, such as heavy plastic or light guage metal. It may also be fabricated to be of any length so as to accommodate any number of plastic oil containers 20. Holes 6, 7 may be provided in rear surface 4 for mounting rack 10 on a wall. Alternatively, holes 8, 9 may be provided in bottom surface 5 for mounting rack 10 on a horizontal surface, such as a workbench.

Following mounting of rack 10 in vertical orientation on a selected vertical or horizontal surface, plastic oil containers 20 are simply loaded into rack 10 from the top opening thereof. As they are loaded, containers 20 are oriented such that they stack on their sides with their cap ends protruding through the frontal opening in rack 10. As the bottom one of the stack of containers 20 in rack 10 is withdrawn therefrom by simply grasping its cap end and pulling it forward, the remainder of the stack of containers 20 moves downward. Since the cap end of each of the containers 20 stacked in rack 10 is visible through the frontal opening in rack 10, the user may inventory his stock of unused, stored oil containers at a glance.

I claim:

1. A rigid, elongate rack positioned vertically for storing and dispensing a vertical stack of rectangular plastic oil containers of the type having a spout that is offset to one side of a centerline of each of the containers, the rack comprising:

a flat rear member;

left and right flat side members extending forward of the rear member and being perpendicular thereto;

an open top through which a supply of plastic oil containers may be loaded into said rack;

a flat bottom member connected to the rear member and to the left and right side members; and a forwardly angled front member extending from one of the left and right side members, the front member being angled to provide a longitudinal frontal opening in said rack for receiving said spout of each of the plastic oil containers stacked in said rack, said longitudinal frontal opening being provided adjacent an opposite one of said left and right side members to that from which said forwardly angled front member extends;

said left and right side members and said front member being notched upward and rearward from the bottom member to create a frontal opening adjacent the bottom member through which only a bottom one of the vertical stack of plastic oil containers may be withdrawn.

2. A rack for storing and dispensing a stack of plastic oil containers as in claim 1, further comprising mounting means on said rear member for mounting said rack in a vertical position on a vertical surface.

3. A rack for storing and dispensing a stack of plastic oil containers as in claim 1, further comprising mounting means on said bottom member for mounting said rack in a vertical position on a horizontal surface.

4. A rack for storing and dispensing a stack of plastic oil containers as in claim 1 wherein said rear member, said left and right side members, and said front member are formed from single metal sheet.

5. A rack for storing and dispensing a stack of plastic oil containers as in claim 1, the rack comprising a molded plastic material.

* * * * *